US009429972B2

(12) United States Patent
Fiocchi et al.

(10) Patent No.: US 9,429,972 B2
(45) Date of Patent: Aug. 30, 2016

(54) LOW DROPOUT REGULATOR

(71) Applicant: ams AG, Unterpremstätten (AT)

(72) Inventors: Carlo Fiocchi, Belgioioso (IT); Paolo Draghi, Pavia (IT)

(73) Assignee: AMS AG, Unterpremstaetten (AT)

( * ) Notice: Subject to any disclaimer, the term of this patent is extended or adjusted under 35 U.S.C. 154(b) by 156 days.

(21) Appl. No.: 14/181,563

(22) Filed: Feb. 14, 2014

(65) Prior Publication Data

US 2014/0239929 A1 Aug. 28, 2014

(30) Foreign Application Priority Data

Feb. 27, 2013 (EP) ..... 13156948

(51) Int. Cl.

| | |
|---|---|
| ***G05F 1/575*** | (2006.01) |
| *G05F 1/565* | (2006.01) |
| *G05F 1/10* | (2006.01) |

(52) U.S. Cl.

CPC ..... *G05F 1/575* (2013.01); *G05F 1/10* (2013.01); *G05F 1/565* (2013.01)

(58) Field of Classification Search

CPC ..... G05F 1/575; G05F 1/56; G05F 1/461; G05F 1/10; G05F 1/565; H02M 3/156

See application file for complete search history.

(56) References Cited

U.S. PATENT DOCUMENTS 5,500,623 A * 3/1996 Kimura ..... H03F 1/3211 330/252
5,825,250 A * 10/1998 Tomasini ..... H03F 1/086 330/292
7,129,686 B1 10/2006 Huang
2006/0197513 A1* 9/2006 Tang ..... G05F 1/575 323/273
2007/0200620 A1* 8/2007 Iriguchi ..... H03F 3/45183 330/9
2007/0216381 A1 9/2007 Tsuchiya et al.
2008/0186091 A1 8/2008 Corsi
2012/0212200 A1 8/2012 Amer et al.
2013/0249294 A1* 9/2013 Saito ..... G05F 1/575 307/43
2014/0042998 A1* 2/2014 Saito ..... G05F 1/468 323/271

OTHER PUBLICATIONS

Or, Pui Ying et al.: "An Output-Capacitorless Low-Dropout Regulator With Direct Voltage-Spike Detection", IEEE, Journal of Solid-State Circuits, vol. 45, No. 2, Feb. 2010, pp. 458-466.

* cited by examiner

*Primary Examiner* — Fred E Finch, III
*Assistant Examiner* — Gustavo Rosario Benitez
(74) *Attorney, Agent, or Firm* — McDermott Will & Emery LLP

(57) ABSTRACT

A low dropout regulator comprises an output transistor with a controlled section between a first supply terminal and an output terminal, and a differential amplifier comprising a feedback input coupled to the output terminal, a reference input receiving a reference voltage, an output connected to a control terminal of the output transistor, and a pair of input transistors connected to a tail current source. A control terminal of a first transistor is connected to the reference input. A control terminal of a second transistor is connected to the feedback input. A first capacitive element is coupled between the output terminal and common connection of the input transistors of one pair with their tail current source. A second capacitive element is coupled between a second supply terminal and the common connection of the input transistors of one pair with their tail current source.

15 Claims, 1 Drawing Sheet

LOW DROPOUT REGULATOR

The invention relates to a low dropout regulator with an output transistor and a differential amplifier controlling the output transistor.

Low dropout, LDO, regulators as a special form of linear voltage regulators are widely known in the art. It is tried to reduce a bias current as much as possible for some LDO regulators. However, such low power LDO regulators are usually more sensitive to load transients. This effects that a response of the LDO regulator is too slow, if the load current at the output of the LDO regulator suddenly changes. As a countermeasure, a large capacitor at the regulated output may be provided, which temporarily supplies the charge to the load. In this way output spikes can be reduced. However, area consumption, for example on a printed circuit board, is increased.

An object to be solved is to provide an improved concept for a low dropout regulator that is more efficient, e.g. in terms of control speed, power consumption and circuit size.

This object is achieved with the subject-matter of the independent claim. Embodiments and developments are the subject-matter of the dependent claims.

A low dropout regulator comprises an output transistor with a controlled section that is coupled between a first supply terminal and an output terminal. The low dropout regulator further comprises a differential amplifier that has a feedback input coupled to the output terminal, a reference input for receiving a reference voltage, and an output connected to a control terminal of the output transistor.

The improved concept is based on the finding that when using a differential input pair for the differential amplifier, spikes at the output of the LDO regulator due to changes of an output load, are not present only at the output terminal but can also be found at the inverting input of the differential amplifier. For example, the differential pair transmits a large spike at the output terminal to a common connection of the differential pair with a rectifying transfer function. It is therefore proposed to provide a capacitor between this common connection and a supply rail for boosting a tail current in the presence of a respective spike at the output terminal having a particular sign. For spikes at the output terminal having a complementary sign, it has been found that, as the common connection of the differential pair has rectifying properties, a capacitor between this node and the output terminal can boost the current. Hence, by providing the two capacitive elements, the differential pair is able to control the output transistor faster in response to any load changes at the output.

For example, an embodiment of a low dropout regulator according to the improved concept comprises the differential amplifier as described above and a first and a second capacitive element. In particular, the differential amplifier comprises at least one pair of input transistors, wherein the input transistors of each pair are commonly connected to a tail current source of the respective pair. A control terminal of a respective first transistor of each pair is connected to the reference input. A control terminal of a respective second transistor of each pair is connected to the feedback input. The first capacitive element is coupled between the output terminal of the low dropout regulator and the common connection of the input transistors of one pair with the respective tail current source. The second capacitive element is coupled between a second supply terminal and the common connection of the input transistors of one pair with the respective tail current source.

For example, the differential amplifier may comprise a single pair of input transistors according to some embodiments, or comprise a first pair and a second pair of input transistors in alternative embodiments, which will explained in more detail below.

Preferably, both the output transistor and the input transistors are formed as field effect transistors. For example, the output transistor is a p-channel field effect transistor, while the input transistors may be n-channel field effect transistors or p-channel field effect transistors. In such embodiments, the common connection of the input transistors with their tail current source can also be called a common source of the input transistors.

It should, however, be noted that the improved is not limited to field effect transistors but can also be performed by well-known bipolar transistors for one or more of the named transistors.

As mentioned before, the first capacitive element is coupled to the output terminal. In particular, the first capacitive element preferably is directly connected to the output terminal. However, the first capacitive element should be at least connected to a terminal that changes its potential proportionally with the potential at the output terminal. For example, a coupling via a voltage divider, in particular a resistive voltage divider, is also a possible option.

The second capacitive element is coupled to the second supply terminal. In various embodiments the second supply terminal may be connected to a ground potential or to the first supply terminal. However, more generally speaking, the second supply terminal may be connected to any terminal with a fixed potential, which acts as a low impedance node.

In various embodiments, an output terminal of the first transistor of each pair is connected to the output of the differential amplifier and thus to the control terminal of the output transistor. For example, if implemented with field effect transistors, the drain terminal of the first transistor of each pair is connected to the output of the differential amplifier.

In various embodiments of the low dropout regulator, the feedback input of the differential amplifier is coupled to the output terminal of the low dropout regulator by a direct connection or by means of a voltage divider. However, other implementations of a feedback network between the feedback input and the output terminal can be applied.

In the various embodiments of the low dropout regulator, the differential amplifier may comprise a current mirror structure for commonly supplying current to each pair of input transistors. For example, the current mirror structure comprises two transistors connected in a current mirror fashion, wherein one transistor of the current mirror structure supplies the first transistor of each pair, while the other transistor of the current mirror structure supplies the second transistor of each pair. Other forms of supplying current to the pair of input transistors are also possible.

As mentioned above, according to one implementation form, the differential amplifier comprises one pair, in particular a single pair of input transistors. The first capacitive element is coupled between the output terminal and the common connection of the input transistors of the one pair with the tail current source. The second capacitive element is coupled between the second supply terminal and the common connection of the input transistors of the one pair with the tail current source. For example, according to this implementation form, the first and the second capacitive element lead to a boost of the tail current in response to load changes or spikes at the output terminal of the LDO regulator. Hence, a control process for controlling the output transistor is performed faster. Furthermore, the two capacitive elements allow that a simple structure of the controlling amplifier of the output transistor can be maintained. Hence, the proposed implementation form is also efficient in terms of space requirements. Furthermore, the proposed implementation form needs no additional current branch, which would lead to an increased power consumption.

According to the alternative implementation form, the differential amplifier comprises a first pair of input transistors and a second pair of input transistors. In this configuration, the first capacitive element is coupled between the output terminal and the common connection of the input transistors of the first pair with the tail current source of the first pair. Furthermore, the second capacitive element is coupled between the second supply terminal and the common connection of the input transistors of the second pair with the tail current source of the second pair.

As described above, one of the capacitive elements improves a response to changes in the positive direction of the load at the output terminal, while the other capacitive element improves the response of load changes in the opposite direction. Hence, according to the implementation form with two pairs of input transistors, the first and the second capacitive element are decoupled from each other, such that if one of the capacitive elements provides a boosting tail current, the other capacitive element is not influencing this current provision effect. As a result, during normal operation, e.g. without sudden load changes, the two pairs of input transistors basically work in parallel, while during load changes, one of the pairs speeds up the response at the output transistor. Hence, the efficiency of the presence of the capacitive elements is increased.

Compared to the implementation form with a single pair of input transistors, a combined size of the input transistors of the first and the second pair may be equal or approximately equal to the size of the transistors of the single pair in order to achieve a similar behaviour during normal operation. In other words, if implemented as an integrated circuit, a total chip area of the implementation form with two transistor pairs could be the same as for the implementation form with a single transistor pair.

The two input stages with the respective transistor pairs and tail current sources can be dimensioned symmetrically, such that both pairs, for example, drive the same or approximately the same current. However, it is also possible to choose a ratio between the two input stages being different from one to one.

For example, according to some embodiments, the tail current source of the first pair drives the same tail current as the tail current source of the second pair.

In alternative embodiments, the tail current source of the first pair drives a higher tail current than the tail current source of the second pair. In particular, if a stabilizing effect resulting from the first capacitive element is greater than the respective effect from the second capacitive element, it may be advantageous to have the tail current source of the first pair having more influence than that of the second pair.

This may also be influenced by choosing an appropriate transconductance of the two pairs. For example, the transconductance of the input transistors of the two pairs can be chosen appropriately.

For example, in some embodiments, the transconductance of the first pair is equal to the transconductance of the second pair. In other embodiments, a transconductance of the first pair is greater than a transconductance of the second pair. Hence, a similar effect can be achieved as by choosing tail current sources with different tail currents.

The same considerations can also be used for dimensioning the first and the second capacitive element, which however is applicable to both the implementation form with a single pair of input transistors and the implementation form with two pairs of input transistors.

For example, in some embodiments, the capacitance values of the first capacitive element and the second capacitive elements are equal or basically equal. In other embodiments, a capacitance value of the first capacitive element is greater than a capacitance value of the second capacitive element.

It should be noted that each of the embodiments described above, in particular the single features of these embodiments, can be combined with each other in various possible combinations.

The text below explains the invention in detail using exemplary embodiments with references to the drawings. Same references are used for same elements or circuit parts, or elements or circuit parts having a similar function in the various figures. Hence, the description of elements or circuit cards in one figure is not necessarily repeated in the following figures.

Figure 1:
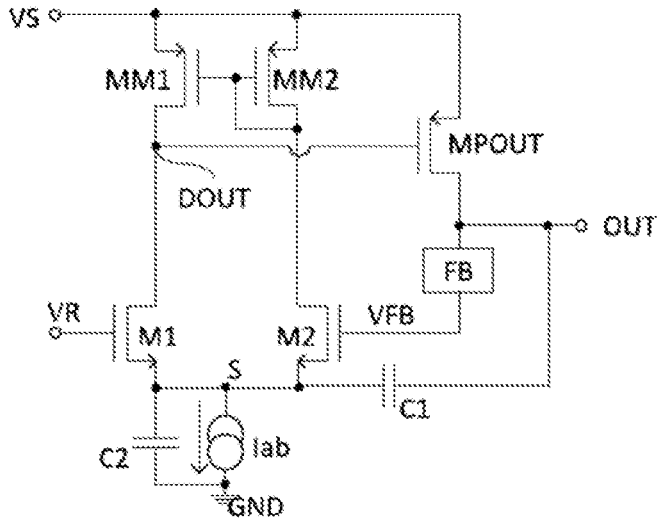
FIG. 1 shows a first embodiment of a low dropout regulator.
Figure 2:
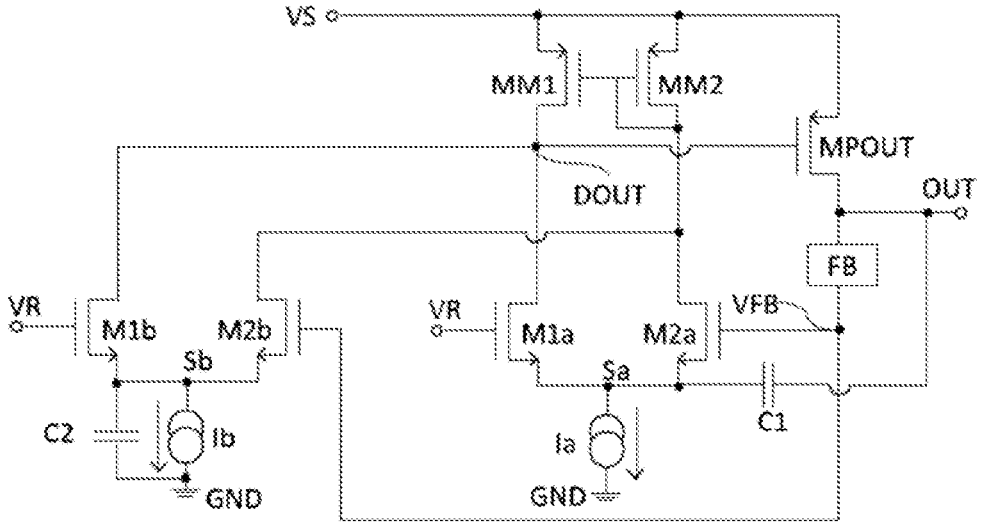
FIG. 2 shows a second embodiment of a low dropout regulator.

With respect to FIG. 1 and FIG. 2, two alternative embodiments of a low dropout regulator according to the improved concept are shown. In both embodiments an output transistor MPOUT is connected between a first supply terminal VS and an output terminal OUT with its controlled section. In particular, a drain connection of the output transistor MPOUT is connected to the output terminal OUT. The output transistor MPOUT is controlled by means of a differential amplifier, which comprises at least one pair of input transistors M1, M2 or M1*b*, M2*b*, M1*a*, M2*a*. The pairs of input transistors are supplied by a current mirror structure comprising mirror transistors MM1, MM2.

In the exemplary embodiments of FIG. 1 and FIG. 2 the transistors are implemented as field effect transistors. In particular, the output transistor MPOUT and the mirror transistors MM1, MM2 are provided as p-channel field effect transistors, while the input transistors M1, M2 or M1*a*, M2*a*, M1*b*, M2*b* are implemented as n-channel field effect transistors. It should, however, be noted that the channel type of the transistors can also be varied and also the use of bipolar transistors is a possible replacement within the scope of the improved concept.

Turning now to FIG. 1, the input stage of the differential amplifier has a single pair of input transistors M1, M2, wherein input transistor M1 is in a current path with mirror transistor MM1 and input transistor M2 is in a current path with mirror transistor MM2. Both input transistors M1, M2 share a common source connection S. The differential amplifier has a reference input VR which is formed by or connected to the control terminal or gate of input transistor M1. Furthermore, the differential amplifier has a feedback input VFB which is formed by or connected to the control terminal or gate of input transistor M2. An output DOUT of the differential amplifier is formed by or connected to the drain terminal of input transistor M1, which is connected to the control terminal or gate of the output transistor MPOUT.

A tail current source Iab is connected between the common source S and a ground potential terminal GND.

The feedback input VFB is coupled to the output terminal OUT by means of a feedback network FB. The feedback network FB may be formed in various well-known ways. For example, the feedback network FB may consist of a simple direct connection like a wire or a resistive element. As an alternative, the feedback network FB may consist of a voltage divider, in particular a resistor divider.

During operation of the low dropout regulator, a reference voltage is provided to the reference input VR, for example from a bandgap circuit or the like. Accordingly, the differential amplifier controls the output transistor MPOUT such that a voltage at the feedback input VFB equals the reference voltage at the reference input VR.

According to the improved concept, a first capacitive element C1, for example a capacitor, is coupled between the common source S and the output terminal OUT. In the embodiment shown in FIG. 1, the first capacitive element C1 is directly connected between the common source S and the output terminal OUT. However, a connection to a terminal, at which a potential changes proportionally to the potential at the output terminal OUT is also a possible option.

A second capacitive element C2, e.g. a capacitor, is coupled between the common source S and a second supply terminal, which in this embodiment is a ground potential terminal GND. In possible variations, the second capacitive element C2 may be connected between the common source S and the first supply terminal VS or any other terminal having a fixed potential. Preferably, that terminal has a low impedance.

The provision of the capacitive elements C1, C2 influences the response of the low dropout regulator to changes of a load connected to the output terminal OUT, in particular to sudden load changes. It can be observed that in a low dropout regulator with a differential pair, spikes due to load changes are not only present at the output but are also directly coupled at the feedback input of the amplifier. Furthermore, a differential pair transmits a large spike at the output OUT to the common source S of the structure with a rectifying transfer function. For example, a pair of n-channel field effect transistors transmits positive spikes while stopping negative ones. In an alternative with p-channel field effect transistors, the transmission of the spikes would be handled in a dual or complementary way. In this way the capacitive element C2 between the common source S and the second supply terminal acts as a tail current boosting in the presence of a positive sign of the spike at the output for the shown n-channel implementation. The same effect would be present in a p-channel implementation for a negative sign of the spike.

With respect to a complementary spike, namely a negative spike for the re-channel implementation and a positive spike for a p-channel implementation, it has been found that the common source has rectifying properties, such that the first capacitive element C1 between the common source S and the output terminal OUT automatically boosts the respective current. In the n-channel implementation, a negative spike at the output terminal OUT pulls down the output terminal of the capacitive element C1 while the terminal at the common source S remains at a constant voltage. This results in an appropriate capacitive current, which crosses the boosting first capacitive element C1 with the same sign as the tail current provided by the tail current source Iab.

In summary, for spikes or changes of a load at the output terminal OUT in both directions, the additional current provided by the respective capacitive element C1, C2, increases the reaction speed of the differential amplifier and thus reduces ripples in the output voltage.

Hence, with the embodiment of FIG. 1, a low dropout regulator is provided which can be implemented efficiently and be space-saving when integrated on a single chip. Furthermore, such a low dropout regulator can also be used for low power applications due to its capability to deal with higher load changes at the output.

In the embodiment of FIG. 1, both capacitive elements C1, C2 are connected to the common source S with one of their terminals. Hence, there may be some interaction or mutual influence if one of the capacitive elements acts as a boosting element. Hence, in FIG. 2 an embodiment is shown where the interaction between the capacitive elements C1, C2 is eliminated or at least reduced.

Instead of a single pair of input transistors, the differential amplifier of the embodiment of FIG. 2 has a first pair of input transistors M1*a*, M2*a* and a second pair of input transistors M1*b*, M2*b*. The drain terminals of the input transistors M1*a*, M2*a*, M1*b*, M2*b* are connected to the current mirror structure MM1, MM2. In particular, the respective first transistors M1*a*, M1*b* share their common drain connection being connected to the first mirror transistor MM1, while the respective second transistors M2*a*, M2*b* share their common drain connection being connected to the second mirror transistor MM2. The drain connection of the first transistors M1*a*, M1*b* forms or is connected to the output DOUT of the differential amplifier. The control terminals of the first transistors M1*a*, M1*b* are both connected to the reference input VR, while the control terminals of the second transistors M2*a*, M2*b* are commonly connected to the feedback input VFB. The input transistors M1*a*, M2*a* of the first pair share a common source Sa, to which a tail current source Ia of the first pair is connected. In a similar fashion, the input transistors M1*b*, M2*b* of the second pair share a common source Sb, to which a second tail current source Ib of the second pair is connected. The respective second ends of the tail current sources Ia, Ib are connected to the ground potential terminal GND.

The first capacitive element C1 is connected between the common source Sa of the first pair and the output terminal OUT. The second capacitive element C2 is connected between the common source Sb of the second pair and a second supply terminal, which in this embodiment is the ground potential terminal GND.

During normal operation of the low dropout regulator, the first differential pair and the second differential pair act in a parallel, in particular due to their corresponding connections to the reference input VR and the feedback input VFB. However, due to the separated common sources Sa, Sb, an interaction, at least a direct interaction between the first and the second capacitive element C1, C2 is eliminated compared to the embodiment of FIG. 1 during the presence of load changes at the output terminal OUT.

As described before for FIG. 1, only one of the capacitive elements C1, C2 becomes active as a boosting element if a spike of the load with a specific direction respectively sign occurs.

If the output has a positive spike, in the case of the shown n-channel implementation, the input transistors M2*a*, M2*b* of the second differential pair both act as voltage followers. While the first capacitive element C1 is bootstrapped and gives no transient current, the second capacitive element C2 undergoes the same spike amplitude at its terminals and an appropriate current is injected in parallel to the tail current contributed by the second tail current source Ib. This results in an appropriate pull-up capability at the output DOUT of the differential amplifier and the gate terminal of the output transistor MPOUT, which is promptly or almost promptly turned off to reduce the spike amplitude. This is, for example, effected because the transistor M2*b* conducts more than the transistor M1*b* due to the larger gate voltage.

Referring to the complementary transition of a load, when a large negative spike affects the output terminal OUT, it is pointed to the fact that only the first transistors M1*a*, M1*b* conduct, such that the second transistors M2*a*, M2*b* are not able to track their gate drops with their source. As a result, the common sources Sa and Sb both stay at a constant voltage. This means that while no transient current crosses the second capacitive element C2, the first capacitive element C1 sees the entire output spike at its terminals, such that an appropriate transient current is injected in the first differential transistor pair M1*a*, M2*a* with the same sign as the current contributed by the first tail current source Ia. Hence, only the first transistor M1*a* of the first pair is conducting, resulting in an appropriate pull-down capability at the differential amplifier output DOUT and the gate of the output transistor MPOUT. This results in turning on the output transistor MPOUT in order to attenuate the output spike amplitude.

As mentioned before, the described principle also works with a p-channel implementation of the differential input pairs, with respective signs changed.

Regarding dimensioning of the circuits shown in FIG. 1 and FIG. 2, the sizes of respective tail current sources and transistors can be chosen such that they correspond to each other. For example, the tail current sources Ia, Ib of FIG. 2 can be dimensioned such that they together drive the same current as the tail current source Iab of FIG. 1. In a similar fashion, the transistors M1, M2 of FIG. 1 can be split up to respective transistors M1*a*, M1*b* and M2*a*, M2*b*. In particular, it becomes obvious that, if the sizes of transistors M1*a*, M1*b* combined together equal the size of transistor M1 and the sizes of transistors M2*a*, M2*b* combined together equal the size of transistor M2, the same behaviour during normal operation, e.g. without sudden load changes, is achieved.

In some embodiments, the first and the second tail current source Ia, Ib are designed such that they drive the same tail current. In other embodiments, the first current source Ia may drive a higher tail current than the second tail current source Ib.

It has been found that in some applications the stabilizing effect from the first capacitive element C1 is greater than that of the second capacitive element C2. Hence, a larger value for the tail current provided by the first tail current source Ia makes the total loop gain more influenced by the presence of first capacitive element C1 than by the second capacitive element C2 and stability is improved.

A further design variation can be the definition of the transconductance of the transistor pairs, which usually is defined by a factor gm. For example, the first and the second differential pair may have the same transconductance. However, due to the reasons described above for the tail current sources, in some applications it may be advantageous to choose the transconductance of the first pair greater than a transconductance of the second pair.

Based on the same considerations, but valid for both the embodiments of FIG. 1 and FIG. 2, capacitance values of the first capacitive element C1 and the second capacitive element C2 may be chosen equal or such that the capacitance value of the first capacitive element C1 is greater than a capacitance value of the second capacitive element C2.

The embodiments described above may be particularly suitable for applications with low power requirements. However, the described principles also work for other power requirements. When integrated within an integrated circuit, the embodiments according to the improved concept can be implemented with little space requirements, resulting in an efficient design of the respective integrated circuit.

What is claimed is:

1. A low dropout regulator, comprising:

an output transistor with a controlled section coupled between a first supply terminal and an output terminal, and a differential amplifier that comprises:

a feedback input coupled to the output terminal;

a reference input for receiving a reference voltage;

an output connected to a control terminal of the output transistor; and at least one pair of input transistors;

wherein the input transistors of each pair are commonly connected to a tail current source of the respective pair, a control terminal of a respective first transistor of each pair is connected to the reference input;

a control terminal of a respective second transistor of each pair is connected to the feedback input;

a first capacitive element is coupled between the output terminal and the common connection of the input transistors of one pair of the at least one pair of input transistors with their respective tail current source, a second capacitive element is coupled between a second supply terminal and the common connection of the input transistors of one pair of the at least one pair of input transistors with their respective tail current source, the differential amplifier comprises a first pair of input transistors and a second pair of input transistors, the first capacitive element is coupled between the output terminal and the common connection of the input transistors of the first pair with their respective tail current source, the second capacitive element is coupled between the second supply terminal and the common connection of the input transistors of the second pair with their respective tail current source, and the tail current source is connected between the common connection and second supply terminal.

2. The low dropout regulator according to claim 1, wherein the tail current source of the first pair of input transistors drives the same tail current as the tail current source of the second pair of input transistors.

3. The low dropout regulator according to claim 1, wherein the tail current source of the first pair of input transistors drives a higher tail current than the tail current source of the second pair of input transistors.

4. The low dropout regulator according to one of claims 1, 2 or to 3, wherein a transconductance of the first pair of input transistors is equal to a transconductance of the second pair of input transistors.

5. The low dropout regulator according to one of claims 2 to 4, wherein a transconductance of the first pair of input transistors is greater than a transconductance of the second pair of input transistors.

6. A low dropout regulator comprising:

an output transistor with a controlled section coupled between a first supply terminal and an output terminal, and a differential amplifier that comprises:

a feedback input coupled to the output terminal;

a reference input for receiving a reference voltage;

an output connected to a control terminal of the output transistor; and a single pair of input transistors;

wherein the input transistors of the single pair are commonly connected to a tail current source, a control terminal of a first transistor of the single pair is connected to the reference input, a control terminal of a second transistor of the single pair is connected to the feedback input, a first capacitive element is coupled between the output terminal and the common connection of the input transistors of the single pair with the tail current source, a second capacitive element is coupled between a second supply terminal and the common connection of the input transistors of the single pair with the tail current source, and the tail current source is connected between the common connection and second supply terminal.

7. The low dropout regulator according to claim 1 or 6, wherein capacitance values of the first capacitive element and the second capacitive element are equal.

8. The low dropout regulator according to claim 1 or 6, wherein a capacitance value of the first capacitive element is greater than a capacitance value of the second capacitive element.

9. The low dropout regulator according to claim 1 or 6, wherein the differential amplifier comprises a current mirror structure for commonly supplying current to each pair of input transistors.

10. The low dropout regulator according to claim 1 or 6, wherein the feedback input is coupled to the output terminal by a direct connection or by means of a voltage divider.

11. The low dropout regulator according to claim 1, wherein respective output terminals of the first transistor of the first and the second pair are connected to the output of the differential amplifier.

12. The low dropout regulator according to claim 1 or 6, wherein the output transistor and the input transistors are formed as field effect transistors.

13. The low dropout regulator according to claim 1 or 6, wherein the second supply terminal is connected to one of the following:

a ground potential;

the first supply terminal;

a terminal with a fixed potential.

14. The low dropout regulator according to claim 6, wherein an output terminal of the first transistor of the single pair is connected to the output of the differential amplifier.

15. The low dropout regulator according to claim 1, wherein the common connection of the input transistors with their respective tail current source shares a common potential.

* * * * *